United States Patent [19]

Koba

[11] 4,289,179

[45] Sep. 15, 1981

[54] VENEER REINFORCING UNIT AND A VENEER REINFORCING DEVICE USING THE SAME

[75] Inventor: Yoshinori Koba, Ohbu, Japan

[73] Assignee: Meinan Machinery Works, Inc., Aichi, Japan

[21] Appl. No.: 88,574

[22] Filed: Oct. 26, 1979

[30] Foreign Application Priority Data

Oct. 26, 1978 [JP] Japan ..... 53-132252
Nov. 6, 1978 [JP] Japan ..... 53-137098

[51] Int. Cl.[3] ..... B27L 5/02

[52] U.S. Cl. ..... 144/211; 144/2 R; 144/212

[58] Field of Search ..... 144/193 R, 209 R, 211, 144/212, 213, 215, 323, 2 R

[56] References Cited

FOREIGN PATENT DOCUMENTS 33-6498 8/1958 Japan .
4636439 9/1967 Japan ..... 144/215
51-1764 1/1976 Japan ..... 144/213

*Primary Examiner*—W. D. Bray
*Attorney, Agent, or Firm*—Armstrong, Nikaido, Marmelstein, & Kubovcik

[57] ABSTRACT

A veneer reinforcing unit is provided. The unit comprises a first cutter which functions as a cutter for trimming a veneer sheet and a second cutter which extends from one or both sides of the blade of said first cutter. During a trimming action of the first cutter, the second cutter cuts in the veneer sheet at its butt ends newly formed by the first cutter. The thus obtained veneer sheet is ready for any reinforcing step. However, if the first and second cutters are additionally provided with a hole to pay out a cord therethrough, the cut formed in the butt end of the veneer sheet firmly hold the cord since the veneer sheet has a tendency to close the cut after the passage of the second cutter, providing a reinforced veneer sheet.

31 Claims, 37 Drawing Figures

VENEER REINFORCING UNIT AND A VENEER REINFORCING DEVICE USING THE SAME

BACKGROUND OF THE INVENTION

The present invention relates to a veneer reinforcing unit and a veneer reinforcing device using the same. More particularly, it relates to a veneer reinforcing unit and a device using the same which provides veneer sheets capable of being reinforced by burying a cord or a string therein in a direction substantially at right angles to a fiber of the veneer sheet.

Conventionally, defective veneer sheets such as those having splits therein should be mended and a solution for this problem will be a major factor to increase yield in the production of plywood.

One of the proposals so far provided for this purpose includes the inventor's Japanese patent application Publication No. 51-1764. The publication discloses a technique of reinforcing a veneer sheet having butt ends already cut neatly. Prior art can not work if a veneer sheet has a defective portion at its center line portion away from both butt ends.

Moreover, the prior art does not extend to treatment of a defective log for the purpose of obtaining a reinforced veneer sheet, and does not incorporate a veneer reinforcing step into the cutting operation on the veneer lathe.

SUMMARY OF THE INVENTION

It is an object of the present invention to provide a veneer reinforcing unit and a veneer reinforcing device which are capable of reinforcing a veneer sheet during a trimming operation thereof.

In one aspect, the present invention provides a veneer reinforcing unit comprising a first cutter having an edge thereon; and a second cutter provided on at least one side of said first cutter and having thereon an edge extending from said first cutter and oriented in a direction substantially the same as the edge of the first cutter, said first cutter extending in a first plane, said second cutter extending in a second plane intersecting the first plane.

In another aspect, it provides a veneer reinforcing device comprising a pair of drive rolls provided rotatably about axes extending parallelly to each other and facing each other to hold a veneer sheet therebetween and feed the same in a predetermined direction; a first cutter having an edge thereon, said edge being set opposite a leading edge of the fed veneer sheet and extending in a plane intersecting the veneer sheet to cut the veneer sheet; and a second cutter provided on at least one side of said first cutter and having an edge extending from said first cutter in a plane in which the fed veneer sheet proceeds.

In a further aspect of the present invention, it provides a veneer reinforcing device used in combination with a veneer lathe comprising a first cutter having an edge thereon; a means for mounting said first cutter on a frame which supports a knife of the veneer lathe, said first cutter extending in a radial plane, said edge being oriented in an opposing relation to a log rotation; and a second cutter provided on at least one side of said first cutter and having an edge extending from said first cutter in an opposing relation to the log rotation.

DETAILED DESCRIPTION OF THE PREFERRED EMBODIMENTS

Figure 1:
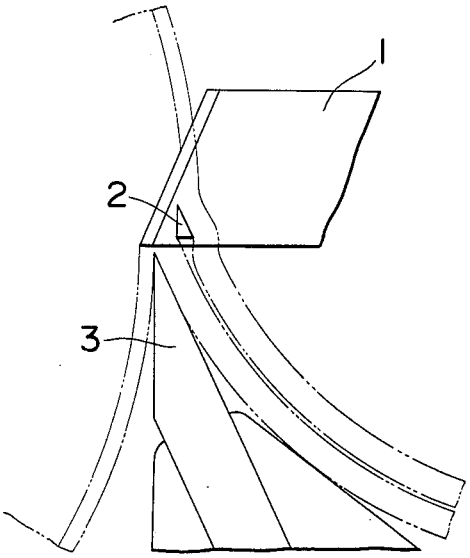
FIG. 1 is a diagrammatic side view showing one example of the veneer reinforcing unit according to the present invention, which unit is physically provided in the vicinity of a knife of a veneer lathe which is turning a log.
Figure 2:
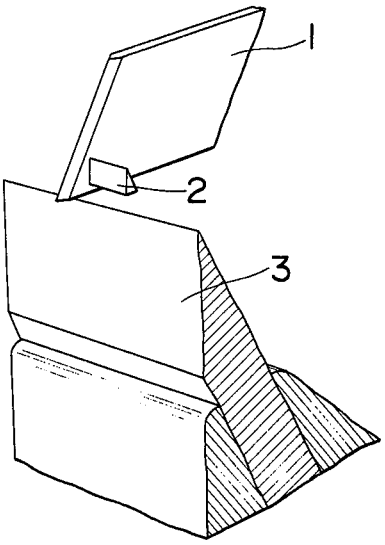
FIG. 2 is a perspective view of FIG. 1.

Referring to FIGS. 1 and 2, numeral 1 designates a first cutter provided in association with knife 3 of a veneer lathe. A first cutter 1 is positioned in the vicinity of each lateral end of the cutting edge of veneer lathe knife 3. Each first cutter extends radially relative to a turned log, and has a cutting edge oriented in an opposing relation to log rotation such that a veneer sheet cut off from the log is trimmed to a predetermined width. A second cutter 2 is rigidly mounted on the inner side relative to the trimmed end of the veneer sheet of each first cutter 1. The cutting edge of said second cutter 2 is oriented substantially in the same direction of cutting as the edge of first cutter 1, but is generally perpendicular thereto. Said first cutter 1 and second cutter 2 form an essential structure of a veneer reinforcing unit according to the present invention.

Figure 3:
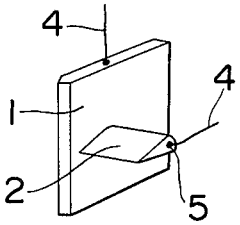
FIG. 3 shows another example of the veneer reinforcing unit which further includes a cord guiding means.
Figure 4:
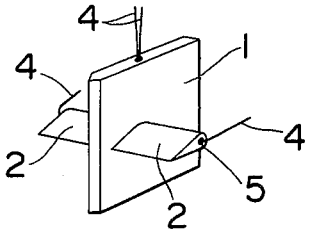
FIG. 4 shows a further example thereof.
Figure 5:
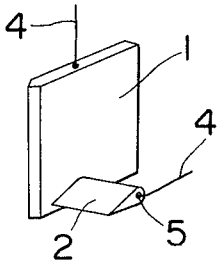
FIG. 5 shows a still further example thereof.
Figure 6:
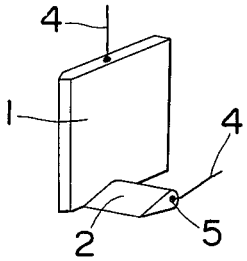
FIG. 6 shows a still further example thereof.

Referring to FIGS. 3 to 6, each of various modifications of the veneer reinforcing unit is formed with hole 5 bored through first cutter 1 and second cutter 2. Cord 3 is paid out through the hole to be guided from outlet 5 formed on an end of second cutter 2 to a downstream side thereof. In FIG. 3, second cutter 2 is provided on one side of first cutter 1 and positioned substantially at a center-line portion thereof. FIG. 4 modification shows a provision of second cutter 2 on each side of first cutter 1. In FIGS. 5 and 6, second cutter 2 is positioned at the base line portion of first cutter 1 with FIG. 5 showing a second cutter near the base line portion and FIG. 6 showing one at the base line portion.

Figure 7:
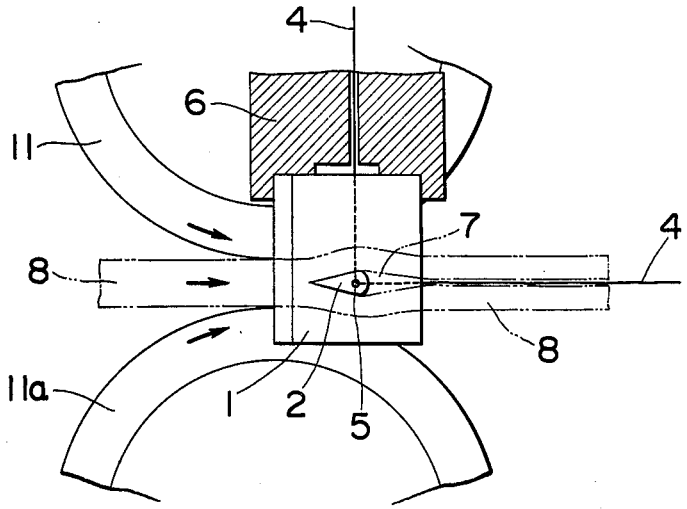
FIG. 7 shows one example of the veneer reinforcing device according to the present invention which device is capable of using thereon any one of the veneer reinforcing units of FIGS. 3 to 6.

Referring to FIG. 7, a veneer reinforcing unit shown in FIG. 3 is provided in the vinicity of a pair of drive rolls 11 and 11*a*. Said rolls are provided rotatably about axes which extend parallelly to each other and positioned in facing relation to each other to hold veneer sheet 8 therebetween and to feed the same in an arrow marked direction. Numeral 6 designates a support member provided on one side of the roll pair. Said support member 6 carries thereon a veneer reinforcing unit composed of first cutter 1 and second cutter 2. Said first cutter 1 has an edge set opposite a leading edge of fed veneer sheet 8 and extending in a plane which vertically intersects the veneer sheet. Second cutter 2 extends in a plane in which fed veneer sheet 8 proceeds. Support member 6 has a hole bored therethrough and communicating with the hole bored through first cutter 1 and second cutter 2. Cord 4 is paid out through said hole and comes out of outlet 5. Therefore, cord 4 is guided by said outlet 5 to a downstream side of second cutter 2 in cut 7 formed in veneer sheet 8 by cutter member 2.

Figure 8:
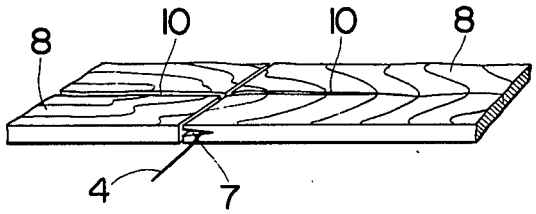
FIG. 8 is a perspective view of a defective veneer sheet which is reinforced by the operation of the veneer reinforcing device using the unit shown in FIG. 3.
Figure 9:
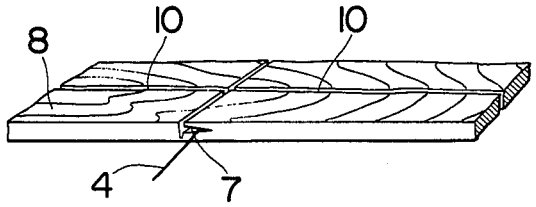
FIG. 9 is a perspective view of another such veneer sheet reinforced by the device using FIG. 5 unit.
Figure 10:
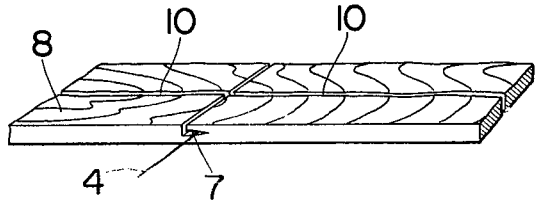
FIG. 10 is a perspective view of a further such veneer sheet reinforced by the device using FIG. 6 unit.

Referring to FIG. 8, veneer sheet 8 having split 10 is reinforced by cord 4 guided into cut 7 which is formed on a butt end of veneer sheet 8 by a reinforcing unit as in FIG. 3 or 4. If a veneer reinforcing unit of FIG. 5 used in combination with the device of FIG. 7 works on a veneer sheet, the configuration of cut 7 is as shown in FIG. 9. The configuration of cut 7 shown in FIG. 10 is due to use of a veneer reinforcing unit shown in FIG. 6. Particularly in case of a device using the veneer reinforcing unit shown in FIG. 3 or FIG. 4, the step of reinforcing a veneer sheet can be incorporated in a step of trimming or dividing the sheet, thus increasing the speed of veneer production. Use of the unit shown in FIG. 5 or 6 does not lead to a trimming or dividing operation of the veneer sheet but the sheet can be reinforced in the same manner as in FIG. 3 and FIG. 4. Further, if the unit in FIG. 5 has cutter member 2 on each side of first cutter 1 as shown in FIG. 4, one sheet of veneer can be reinforced with two pieces of cord buried in the sheet by one step.

Figure 11:
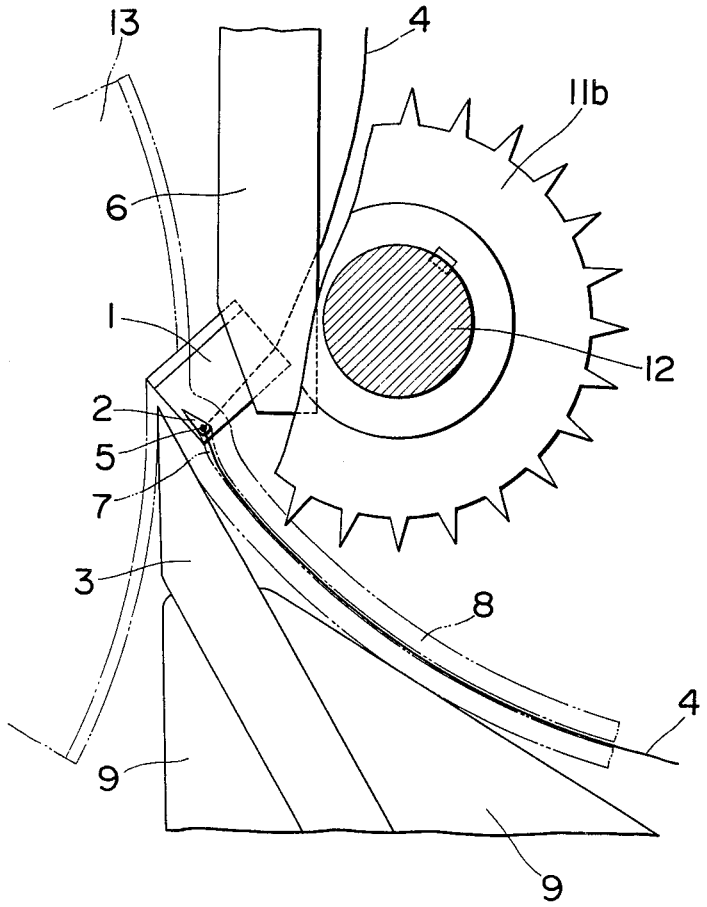
FIG. 11 is a diagrammatic side view sectional in part of another example of the veneer reinforcing device which is further provided with a cord guiding means.
Figure 12:
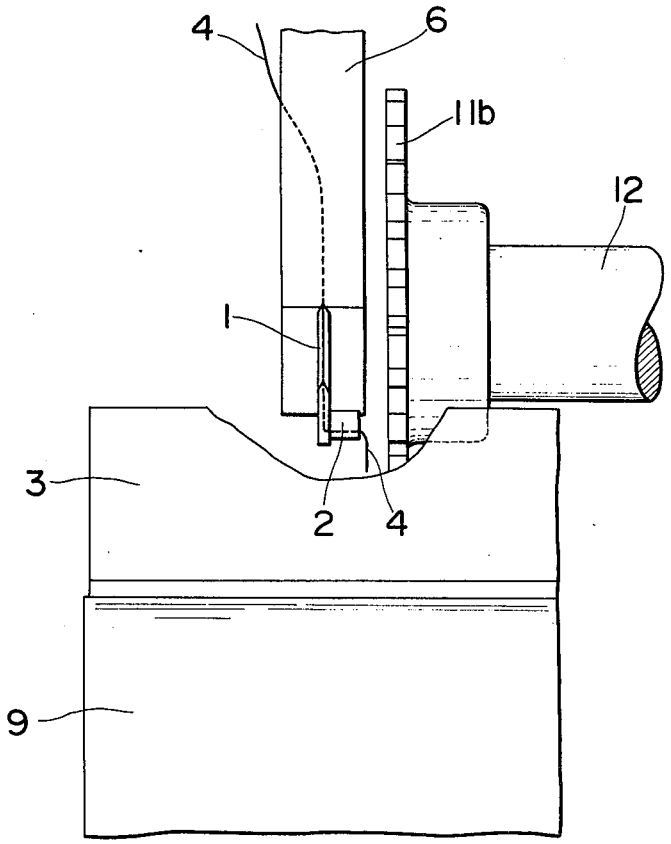
FIG. 12 is a front view of FIG. 11 broken in part.

Referring now to FIGS. 11 and 12, the veneer reinforcing unit as shown in FIGS. 3 to 6 is used in combination with a veneer lathe. Veneer lathe knife 3 is rigidly mounted on knife support 9. In the vicinity of said knife 3, roll 11*b* having a plurality of edged projections therearound is mounted on axle 12 connected to a variable drive motor (not shown) such that said roll 11*b* rotates in synchronism with log 13 turned on the veneer lathe to provide an additional torque to turned log 13. Said axle 12 is journalled by any suitable support member physically connected to knife support 9. As depicted, the veneer reinforcing unit is mounted on support member 6 facing a log periphery near each axial end of roll 11*b* such that first cutter 1 has its edge slightly ahead of the edge of knife 3 whereas second cutter 2 has its edge slightly behind the edge of knife 3. In this position, first cutter 1 cuts in log 13 ahead of the edge of knife 3 whereas second cutter 2 cuts in a newly formed butt end of veneer sheet 8 past the edge of knife 3. In general, the veneer lathe has a pressure bar provided ahead of knife 3 to press log 13 to prevent splitting in the cut log. A similar pressure bar is mounted on a suitable support (not shown) which in turn is mounted on knife support 9. Support member 6 is preferably mounted on knife support 9 by way of said pressure bar support. This assembly follows the log periphery in accordance with the decrease of log diameter during the cutting operation while maintaining their relationship between components including first cutter 1, second cutter 2, support member 6, and knife support 9.

With log 13 turned, first cutter 1 cuts in each axial end portion of log 13, which in turn is cut into veneer sheet 8 neatly trimmed. Second cutter 2 cuts into each clean cut butt end of veneer sheets 8, forming cut 7 and guiding cord 4 therein. Thus, the veneer lathe outputs a veneer sheet reinforced as shown in FIG. 8. Provision of roll 11*b* though not essential in this embodiment is preferable since it exerts an additional force on veneer sheet 8 to overcome the cutting resistance of second cutter 2. It is also preferable that roll 11*b* engages veneer sheet 8 near second cutter 2.

Figure 13:
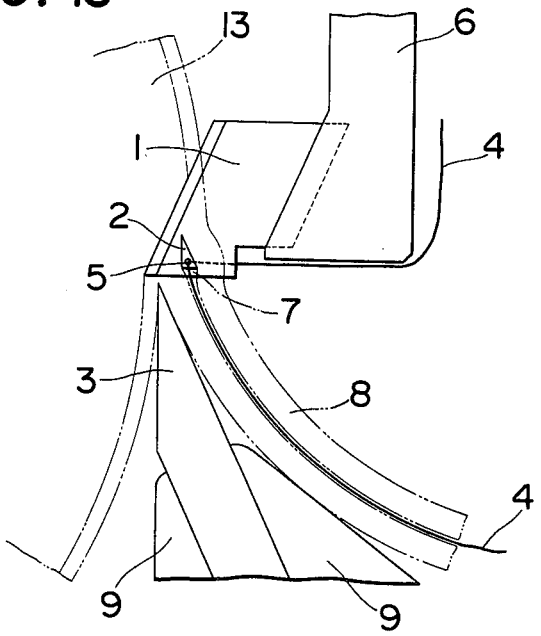
FIG. 13 is a diagrammatic side view sectional in part of a further example of the veneer reinforcing device.
Figure 14:
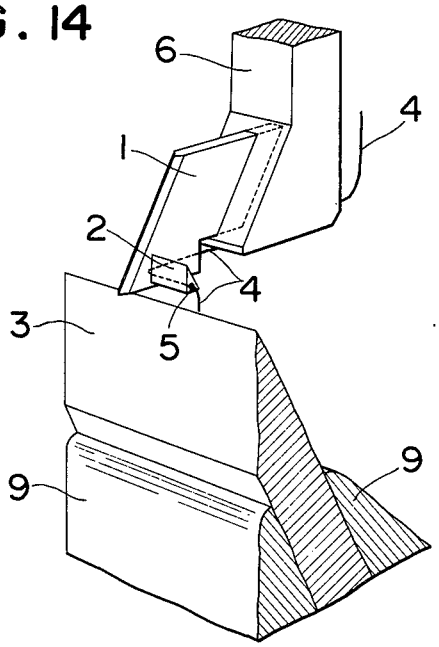
FIG. 14 is a perspective view of FIG. 13.

Referring to FIGS. 13 and 14, the general structure of the device is substantially the same as the device of FIGS. 11 and 12, except that a driving roll is not provided and that second cutter 2 is provided ahead of veneer lathe knife 3 with the result that said second cutter works on log 13 in place of veneer sheet 8.

Figure 15:
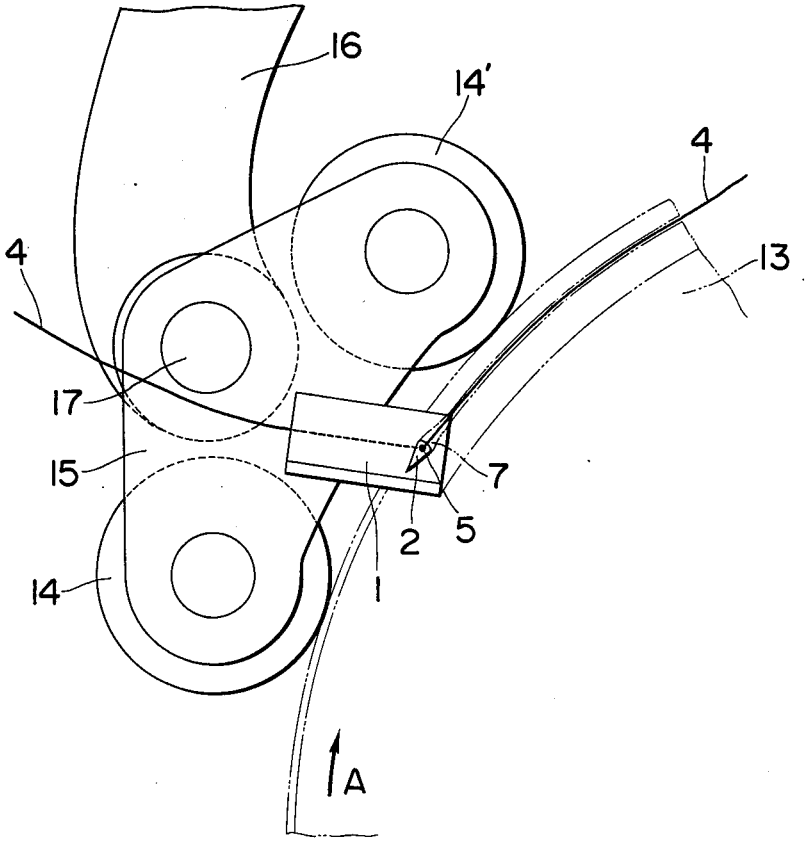
FIG. 15 is a diagrammatic side view sectional in part of a still further embodiment of the veneer reinforcing device.

Referring to FIG. 15, the veneer reinforcing unit is provided far ahead of veneer lathe knife 3 (not shown). Numerals 14 and 14' designate a pair of idler rolls rotatably mounted on support member 15. The unit is provided on said support member 15 between said rolls 14 and 14' functioning as a pressure means for second cutter 2. Support member 15 is operatively connected to arm 16 by way of pin 17. Said arm 16 is swingably provided on a veneer lathe assembly to forcibly bring the unit in a cutting engagement with log 13 down to a predetermined depth. Depending on demand, various types of reinforced veneer sheets as shown in FIGS. 8 to 10 can be obtained by selectively using any one of the units shown in FIGS. 3 to 6.

The reinforcing unit can be put to work at any position around the log periphery depending on whether a log is to be reinforced prior to the cutting operation by the veneer lathe or a veneer sheet is to be reinforced subsequent to the cutting operation by the veneer lathe.

Next, the following differences are observed when comparing the reinforcement of a veneer sheet already cut off from a log with that of a log prior to its being subjected to a cutting operation.

1. Veneer sheets have many cracks therethrough such as formed during a tenderizing operation. When subjected to the cutting operation by the reinforcing unit, their cut ends or cuts tend to be irregular. However, using the present invention before cutting a veneer from the log provides neat cut ends or cuts because there are no such adverse factors.

2. Veneer sheets tend to curl and have a need for an extra step of supplying one by one to the reinforcing step. A log has no such disadvantages.
3. Veneer sheets must be fed for the reinforcing step. When the reinforcing unit is provided on a veneer lathe, a turned log eliminates the need for a particular feeding means.
4. A merit of replacement of the reinforcing unit as seen in FIG. 7 is the general structure is simpler than the device shown in FIGS. 11 to 14.
5. Reinforcement of veneer sheets after being cut from the log requires an additional step in plywood production. Subjecting the log turned on a veneer lathe to the reinforcing step provides a simpler procedure in the whole plywood production line.

It may thus be applicated how advantageous it would be to incorporate the reinforcing unit into a veneer lathe.

Figure 16:
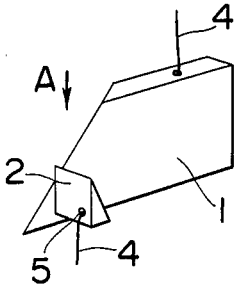
FIGS. 16 to 21 show various modifications of the veneer reinforcing unit.
Figure 17:
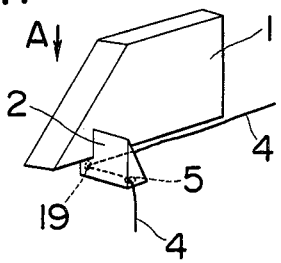
Figure 18:
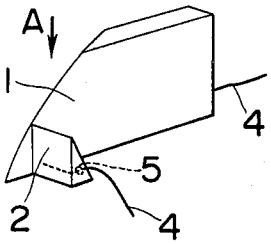
Figure 19:
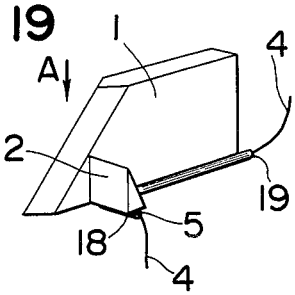

Referring to FIGS. 16 to 21, various modifications of the veneer reinforcing unit will be explained. First cutter 1 shown in FIGS. 16 and 17 has only one slope on its edge portion. The edge line of first cutter 1 shown in FIG. 18 is curved. Each of first cutter 1 and second cutter 2 extending from the blades thereof has a hole bored therethrough to be in communication with each other. Said hole has outlet 5 on the exposed surface of second cutter 2 for guiding cord 4 paid out therethrough. The most preferable position of said outlet 5 is an end portion of second cutter 2 because cord 4 is guided into the bottom of cut 7, where cut 7 formed by second cutter 2 closes most firmly after the passage of second cutter 2 since wood tends to regain its original shape. Outlet 5 is positioned on the end of second cutter 2 in FIGS. 3 to 6. FIG. 17 shows that it is provided on the end portion of the back of cutter 2. These positions have another advantage that outlet 5 is less likely to be blocked by entry of wood dust since the workpiece is fed from the arrow marked direction A. Said hole may be replaced by guide pipe 18 preferably provided at the back of second cutter 2 as shown in FIG. 19. However, guide pipe 18 may be provided separately from second cutter 2. Although not shown, a guide groove may be formed on second cutter 2. Inlet 19 of pipe 18 is positioned as shown in FIGS. 17, 18 and 19. A preferable position is downstream of the whole unit, where log 13 or veneer sheet 8 will not interfere with cord 4.

Figure 20:
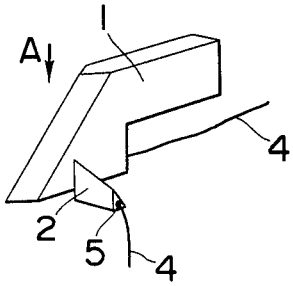

Second cutter 2 is thin and preferably tapers in thickness towards the end thereof as shown in FIG. 20.

Figure 21:
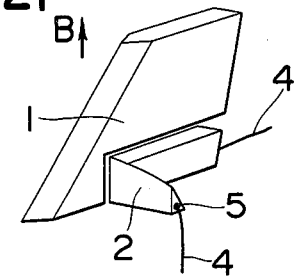

Next, the positional relationships between first cutter 1 and second cutter 2 will be explained referring ti FIGS. 16 to 18. A log or a veneer sheet rotates or proceeds in a direction shown by an arrow mark A. The edge of second cutter 2 of the unit of FIG. 16 is positioned ahead of the edge of first cutter 1. The edge of second cutter 2 is positioned behind the edge of first cutter 1 in FIG. 17. However, it may be abreast with the edge of first cutter 1 as shown in FIG. 18. These modifications are possible because the edges of both cutters proceed substantially in a same plane to cut log 13 or veneer sheet 8. FIG. 21 shows a modification in which second cutter 2 is detachably provided relative to first cutter 1. In this modification, it is preferable that second cutter 2 is mounted on first cutter 1 in order that both edges proceed in the same plane. The edge of first cutter 1 may cut into log 13 or veneer sheet 8 in a slantwise manner, thus allowing its extention at an angle relative to the direction A as shown in FIGS. 16 to 19. In the foregoing modifications, second cutter 2 extends in a plane perpendicular to first cutter 1. However, this angular arrangement is not important. In other words, it is sufficient that first cutter 1 extends in a first plane whereas second cutter 2 extends in a second plane which intersects the first plane.

Figure 22:
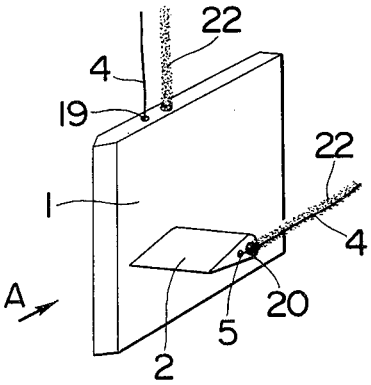
FIGS. 22 and 23 show further modifications of the veneer reinforcing unit having an adhesive supplying means.
Figure 23:
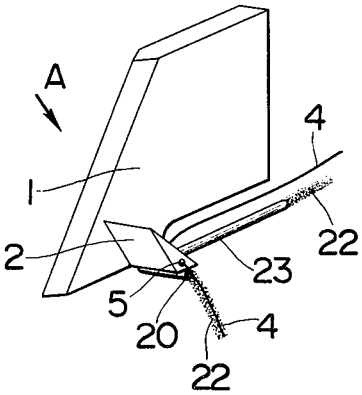

Referring to FIG. 22, the reinforcing unit is provided with another hole bored through first cutter 1 and second cutter 2. Said hole has outlet 20 on an exposed surface of second cutter. Through said hole and outlet 20, adhesive 22 is supplied into cut 7 formed by second cutter 2. Referring to FIG. 23, adhesive 22 is supplied through L-shaped pipe member 23 with its outlet arm provided on the back of cutter 2. However, it may be separated from cutter 2 on the downstream side thereof. Modification concerning the positioning of adhesive outlet 20 varies in a same way as cord outlet 5.

It is also allowable that cord 4 and adhesive 22 are supplied to pass through a common hole in the unit. Otherwise, an adhesive impregnated cord may be paid out through such a common hole. In these cases, however, it is required that said adhesive is of a moisture-curing type such as a polyurethane resin. When the adhesive is supplied into cut 7 formed in a log or a veneer sheet immediately after being cut off from the log, the adhesive sets by the action of moisture contained in the wood.

Figure 24:
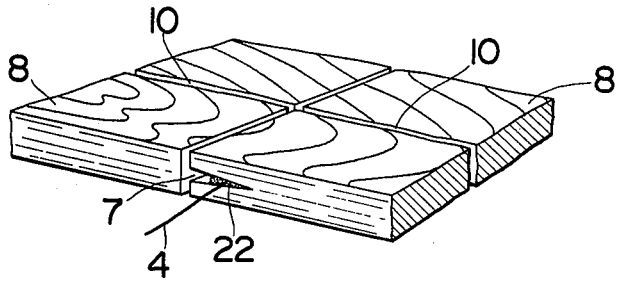
FIGS. 24 to 26 show veneer sheets reinforced by the unit using an adhesive supplying means as shown in FIGS. 22 and 23.
Figure 25:
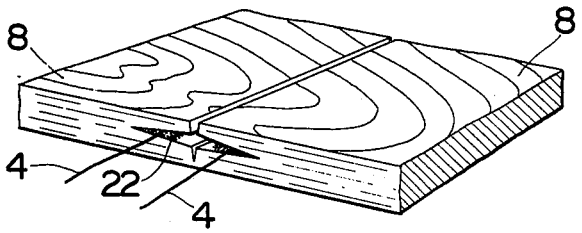
Figure 26:
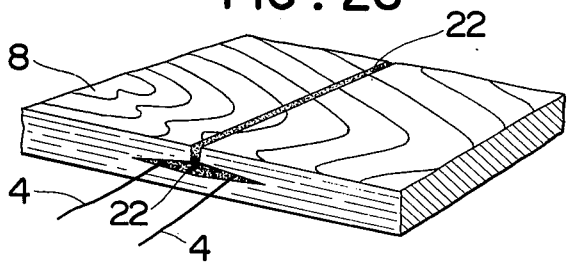
Figure 27:
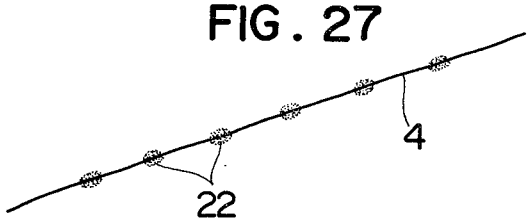
FIG. 27 shows a cord subjected to a spot-application of an adhesive.

Referring to FIGS. 24 to 26, veneer sheet 8 is additionally reinforced by adhesive 22 entering in cut 7. For this purpose, adhesive pipe member 23 may be replaced by any suitable means to perform a spot application of adhesive on cord 4 as shown in FIG. 27. Adhesive varies from hot-melt adhesives or moisture-curing adhesives depending on whether the work-piece to be reinforced is a dried veneer sheet or a log having same moisture. The time required for setting adhesive 22 is not important since cord 4 provides a sufficient reinforcing effect in cooperation with the property of log 13 or veneer sheet 8 which tends to regain its original shape and close cut 7 immediately after second cutter 2 passes therein.

Figure 28:
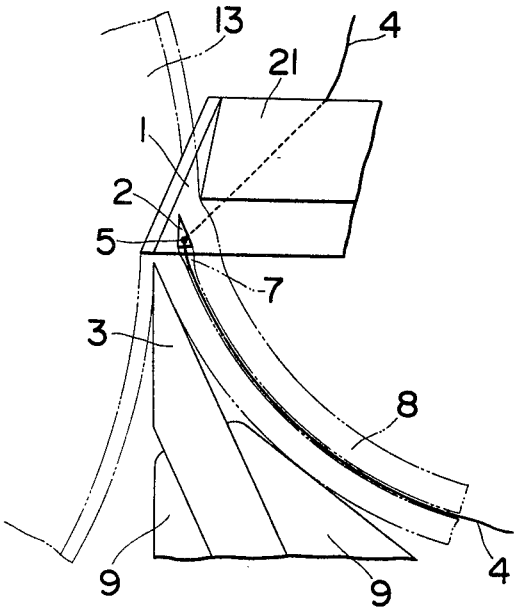
FIG. 28 shows a still further embodiment of the veneer reinforcing device further incorporating a pressure means ahead of the cutter member.
Figure 29:
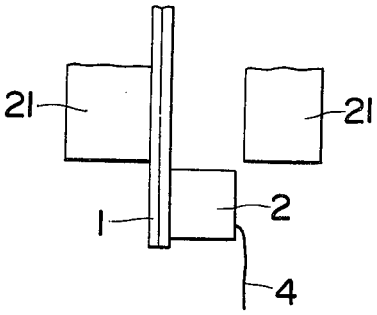
FIG. 29 is a diagrammatic illustration of the embodiment of FIG. 28 viewed from the log side and showing a positional relationship of the first cutter, the second cutter, and the pressure means.

Referring to FIGS. 28 to 33, there are provided other embodiments of the present invention. As shown in FIG. 28, pressure member 21 in the form of a nose bar is provided on first cutter 1. It is preferable that pressure member 21 is rigidly mounted on first cutter 1 regardless of whether fixedly or detachably. Since second cutter 2 is also mounted rigidly on first cutter 1, pressure member 21 presses log 13 at a predetermined position ahead of second cutter 2 and second cutter 2 advances in the log or veneer sheet at a predetermined depth from the surface thereof. In this way, pressure member 21 controls the advance of second cutter 2 which is apt to make unstable movements due to the heterogeneous quality of log 13.

In FIG. 28, the positional relationships of pressure member 21 and second cutter 2 is substantially the same as that of a nose bar and a knife in a veneer lathe in that pressure member 21 is provided ahead of second cutter 2. The embodiment shown in FIG. 29, however, has its pressure member 21 provided ahead of second cutter 2 in a staggered relation to prevent a possible blocking of wood slivers between the log periphery and second cutter 2. This advantage is also observed in the embodiment of FIG. 32 in which pressure member is provided far ahead of second cutter 2.

Figure 30:
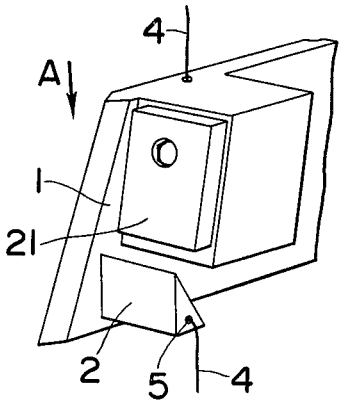
FIGS. 30 to 33 show various modifications of the pressure means.
Figure 31:
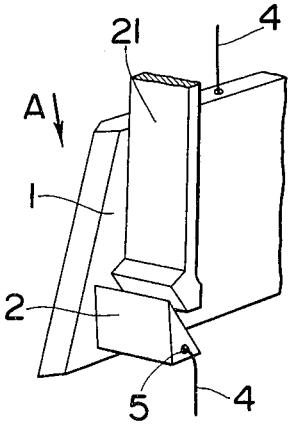
Figure 32:
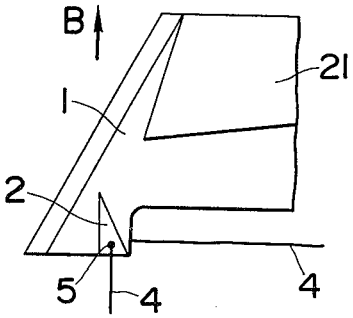
Figure 33:
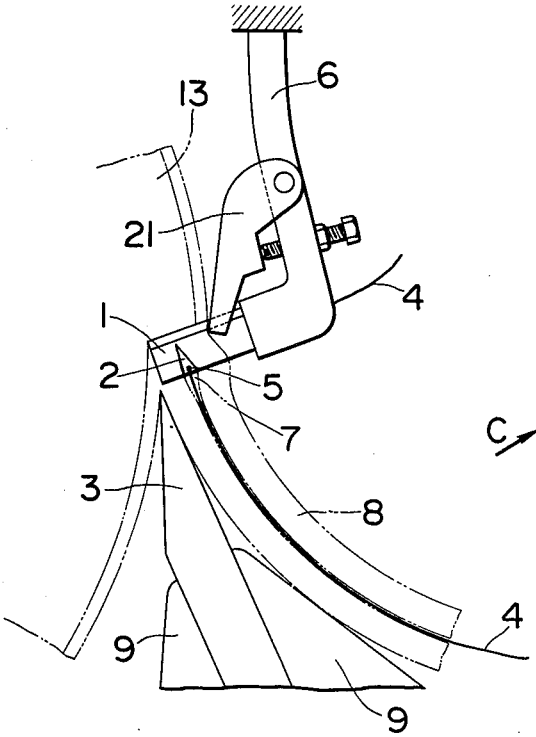

The modification of FIG. 30 features detachable pressure member 21, which can be replaced with another pressure member having different thickness to incrementally adjust pressing strength. In FIG. 33, pressure member 21 is pivotally mounted on support 6 to allow an infinite adjustment of pressing strength by manipulation of a pin as depicted. Said support 6 is resiliently provided to properly press pressure member 21 onto a log periphery and second cutter 2. The adjustment of pressure member 21 may be performed by remote control in place of using the adjuster bolt.

Provision of pressure member 21 is instrumental in producing a veneer sheet having cut 7 neatly formed on its each butt end. Particularly, pressure member 21 having a double face configuration, prevents cut 7 from running up to the veneer surface until slivers come off the veneer surface.

Figure 34:
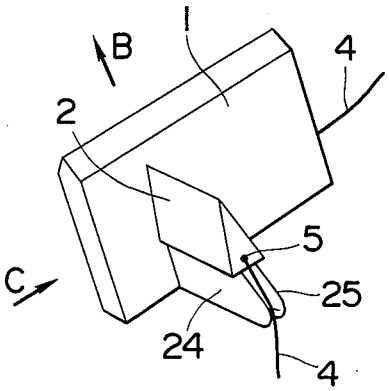
FIGS. 34 and 35 show a still further embodiment of the veneer reinforcing unit, further including auxiliary cord guide means.
Figure 35:
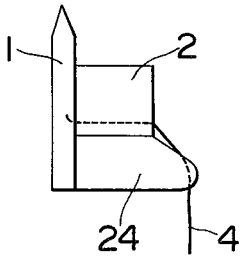
Figure 36:
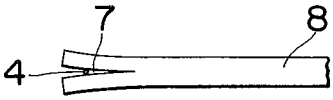
FIGS. 36 and 37 show the positions taken by the cord guided by auxiliary cord guide means shown in FIGS. 34 and 35.
Figure 37:
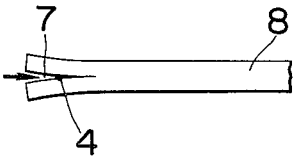

Referring to FIGS. 34 and 35, numeral 24 designates a guide plate provided on the downstream side (relative to the advance of the unit as designated by arrow mark B) of second cutter 2. Said guide plate 24 has narrow-width guide surface 25, which extends from near cord outlet 5 to the far side of first cutter 1. Cord 4 paid out from outlet 5 (FIG. 36) is guided toward a split developped from cut 7 (FIG. 37) to ensure that said cord 4 is secured by the closing action of cut 7 as will be seen from the configuration of guide plate 24 shown in FIG. 35 which is a figure of the unit viewed from the direction C arrow-marked in FIG. 34. Therefore, it is preferable that guide surface 25 is concave, extending from near outlet 5 backward and slantwise. It is also preferable to provide said guide plate 25 integrally with or detachably from the back of second cutter 2. In case, however, outlet 5 is positioned on said back of cutter 2, guide plate 25 may be separated from the back as long as guide plate 25 is on the downstream side of second cutter 2 to permit a smooth paying out of cord 4.

A veneer reinforcing unit or device according to the present invention realizes with a simple structure prevention of splits in veneer sheets or reinforcement of veneer sheets having splits therein. Moreover, its installation can be achieved at a low cost and the operation in carried out with minimum trouble. The reinforced veneer sheet shows a satisfactory strength during handling thereof for plywood manufacturing, since the reinforcing unit or device allows use of an inexpensive and durable cord of natural or synthetic resin, a cord having a large coefficient of friction, and a metal cord together with adhesive of various kinds.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A veneer reinforcing unit comprising a first cutter having a cutting edge thereon; a second cutter provided on at least one side of said first cutter and having thereon a cutting edge extending perpendicularly from said first cutter and oriented substantially in a same cutting direction as the edge of the first cutter, said first cutter extending in a first plane, said second cutter extending in a second plane which intersects the first plane; and means on said second cutter defining means for guiding a cord to a downstream side of the second cutter into a cut made by the second cutter.

2. A veneer reinforcing unit according to claim 1, wherein said means on said second cutter includes a hole bored through the second cutter.

3. A veneer reinforcing unit according to claim 2, wherein said hole has an outlet on an exposed surface of the second cutter.

4. A veneer reinforcing unit according to claim 3, wherein said exposed surface extends at an end of the second cutter.

5. A veneer reinforcing unit according to claim 3, wherein said exposed surface extends at a back of the second cutter.

6. A veneer reinforcing unit according to claim 5, wherein said back extends at an end portion of the second cutter.

7. A veneer reinforcing unit according to claim 1, wherein said means on said second cutter includes a guide pipe provided on the downstream side of the second cutter.

8. A veneer reinforcing unit according to claim 7, wherein said guide pipe has an open end positioned in the vicinity of an end portion of the second cutter.

9. A veneer reinforcing unit according to any one of the claims from 1 or 2 to 8, wherein said second cutter is fixedly mounted on the first cutter.

10. A veneer reinforcing unit according to any one of the claims from 1 or 2 to 8 wherein said second cutter is detachably mounted on the first cutter.

11. A veneer reinforcing unit according to any one of claims 2 to 8, wherein the edge of said second cutter is positioned behind the first cutter edge.

12. A veneer reinforcing unit according to any one of the claims 2 to 8, wherein the edge of said second cutter is positioned abreast with the first cutter edge.

13. A veneer reinforcing unit according to any one of claims 2 to 8, wherein the edge of said second cutter is positioned ahead of the first cutter edge.

14. A veneer reinforcing unit according to any one of the claims from 1 or 2 to 8, wherein said second cutter is positioned at a centerline portion of the first cutter.

15. A veneer reinforcing unit according to any one of the claims from 1 or 2 to 8, wherein said second cutter is positioned at a baseline portion of the first cutter.

16. A veneer reinforcing unit according to any one of the claims from 1 or 2 to 8, wherein said second cutter tapers towards an outer end thereof.

17. A veneer reinforcing unit according to any one of the claims from 2 to 6, further including a means for supplying an adhesive on the downstream side of the second cutter.

18. A veneer reinforcing unit according to claim 17, wherein said adhesive supplying means includes a hole bored through the second cutter.

19. A veneer reinforcing unit according to claim 18, wherein said hole has an outlet on an exposed surface of the second cutter.

20. A veneer reinforcing unit according to claim 17, wherein said adhesive supplying means includes a pipe member provided on the downstream side of the second cutter.

21. A veneer reinforcing unit according to claim 20, wherein said pipe member has an open end in the vicinity of an end portion of the second cutter.

22. A veneer reinforcing unit according to claim 1, wherein said second cutter has an auxiliary guide means for further guiding the cord paid out of the means for guiding to the downstream of the second cutter.

23. A veneer reinforcing device comprising a pair of drive rolls provided rotatably about axes extending parallelly to each other and facing each other to hold a veneer sheet therebetween and feed the same in a predetermined direction; a first cutter having a cutting edge thereon, said edge being set opposite a leading edge of the fed veneer sheet and extending in a plane intersecting the veneer sheet to cut the veneer sheet; a second cutter fixed onto at least one side of said first cutter and having a cutting edge extending from said first cutter in a plane in which the fed veneer sheet proceeds, and means on said second cutter defining means for guiding a cord to a downstream side of the second cutter into a cut made by the second cutter.

24. A veneer reinforcing device according to claim 23, wherein said means on said second cutter includes a hole bored through the second cutter.

25. A veneer reinforcing device according to claim 23, further including a means for supplying a cord to said means for guiding.

26. A veneer reinforcing device used in combination with a veneer lathe comprising a first cutter having a cutting edge thereon and provided in association with a veneer lathe knife; a means for mounting said first cutter on a frame which supports the veneer lathe knife, said first cutter radially extending relative to a turned log, said edge being oriented in an opposing relation to the log rotation; a second cutter fixed onto at least one side of said first cutter and having a cutting edge extending from said first cutter in an opposing relation to the log rotation; and means on said second cutter defining means for guiding a cord to a downstream side of the second cutter into a cut made by the second cutter.

27. A veneer reinforcing device according to claim 26, wherein said means on said second cutter includes a hole bored through the second cutter.

28. A veneer reinforcing device according to claim 27, wherein said first cutter is positioned in the vicinity of the veneer lathe knife.

29. A veneer reinforcing device according to claim 28, wherein the edge of the second cutter in positioned ahead of the edge of the veneer lathe knife.

30. A veneer reinforcing device according to claim 28, further including a pressure means associated with said second cutter for pressing a log periphery.

31. A veneer reinforcing device according to claim 27, wherein said first cutter is positioned far ahead of the veneer lathe knife, said first cutter mounting means being adapted to follow a log periphery.

* * * * *